US009362019B2

(12) United States Patent
Janah et al.

(10) Patent No.: US 9,362,019 B2
(45) Date of Patent: Jun. 7, 2016

(54) ELECTRICAL CABLE RESISTANT TO PARTIAL DISCHARGES

(71) Applicant: NEXANS, Paris (FR)

(72) Inventors: Hakim Janah, Viry-Chatillon (FR); Thiery Daumand, Guignen (FR); Virak Phul, Wissous (FR); Patrick Rybski, Yerres (FR); Pascal Clouet, Vigneux sur Seine (FR); Wilfried Lecluse, Saint Cyr l'ecole (FR); Rui Manuel Da Silva, Chilly-Mazarin (FR)

(73) Assignee: Nexans, Paris (FR)

( * ) Notice: Subject to any disclaimer, the term of this patent is extended or adjusted under 35 U.S.C. 154(b) by 111 days.

(21) Appl. No.: 14/177,455

(22) Filed: Feb. 11, 2014

(65) Prior Publication Data

US 2014/0224521 A1 Aug. 14, 2014

(30) Foreign Application Priority Data

Feb. 12, 2013 (FR) ..... 13 51178

(51) Int. Cl.

| | |
|---|---|
| ***H01B 7/00*** | (2006.01) |
| ***H01B 3/44*** | (2006.01) |
| ***H01B 7/29*** | (2006.01) |

(52) U.S. Cl.
CPC ..... *H01B 3/445* (2013.01); *H01B 7/292* (2013.01)

(58) Field of Classification Search
USPC ..... 174/110 R–110 PM, 120 R, 120 SR, 174/121 R, 121 SR, 36
See application file for complete search history.

(56) References Cited

U.S. PATENT DOCUMENTS

| | | | | |
|---|---|---|---|---|
| 4,617,449 | A * | 10/1986 | Weitzel et al. | 392/469 |
| 2005/0013998 | A1 | 1/2005 | Lacourt | |
| 2008/0081499 | A1 * | 4/2008 | Sumi et al. | 439/207 |

FOREIGN PATENT DOCUMENTS

| | | | | |
|---|---|---|---|---|
| WO | WO 02/067630 A1 * | 8/2002 | | H05B 3/56 |

* cited by examiner

*Primary Examiner* — William H Mayo, III
(74) *Attorney, Agent, or Firm* — Sofer & Haroun, LLP

(57) ABSTRACT

An electrical cable having an elongate electrically conductive element (2) and at least one electrically insulating fluoropolymer layer (4) surrounding the electrically conductive element (2). The electrical cable is exempt from polyimide-containing layer between the electrically conductive element and the electrically insulating fluoropolymer layer.

16 Claims, 2 Drawing Sheets

ELECTRICAL CABLE RESISTANT TO PARTIAL DISCHARGES

RELATED APPLICATION

This applications claims the benefit of priority from French Patent Application No. FR 13 51178, filed on Feb. 12, 2013, the entirety of which is incorporated by reference.

BACKGROUND

1. Field of the Invention

The present invention relates to an electrical cable, and typically but not exclusively applies to the electrical cables used in aeronautics, for example on board airplanes.

2. Description of Related Art

This type of electrical cable must meet many criteria if it is to be used in aeronautics, especially when it is to be subjected to high voltages, about 230 V AC or about 1270 V DC, and when it is to be located in depressurized zones.

These relatively high voltages, in combination with aeronautics-related factors, such as moisture, high temperatures and low pressures, may generate partial discharges (PDs) in electronic equipment such as electrical cables. Partial discharges, which are minuscule electrical arcs in the electrical insulator of the cable, cause, over time, the electrical insulator to degrade, which may lead to it rupturing.

Other criteria may also be taken into account such as the weight and diameter of said cable, which must not be excessive, and the markability of said cable in order, when required, to allow it to be identified.

In the prior art, it is known to equip airplanes with hook-up wires, these wires comprising a conductive element surrounded by a 0.017 to 0.065 mm-thick first polyimide layer, itself surrounded by a 0.1 to 0.22 mm-thick polytetrafluoroethylene PTFE layer for nominal conductive cross sections ranging from 0.15 to 120 $mm^2$. However, for such hook-up wires the applied voltage is about 115 V.

Document EP 1 498 909 relates to a multilayer insulation having the function of insulating and/or protecting electrically conductive hardware such as aeronautical cables. This insulation comprises, in succession, around the electrical element to be protected, a first polyimide (PI) layer, a second tetrafluoroethylene/perfluoro(alkylvinylether) (PFA) copolymer layer, and optionally an external polytetrafluoroethylene (PTFE) layer. The thickness of the PI layer ranges from 8 to 150 μm and the thickness of PTFE ranges from 1 to 200 μm. However, the resistance to partial discharges of an electrical cable surrounded by this multilayer isolation is also not optimized for high voltages, such as voltages of about 230 V AC or about ±270 V DC.

OBJECTS AND SUMMARY

The aim of the present invention is to overcome the drawbacks of the prior art by providing an electrical cable that is resistant to partial discharges, especially when the electrical cable is intended for the aeronautics field and is subjected, in flight, to high temperatures (in the region of 150° C.) and low pressures (about 150 mbar).

The subject of the present invention is an electrical cable comprising:

an elongate electrically conductive element; and at least one electrically insulating fluoropolymer layer, surrounding said electrically conductive element, characterized in that the electrical cable is exempt from polyimide-containing layer between said electrically conductive element and said electrically insulating fluoropolymer layer.

More particularly, the electrical cable of the invention does not comprise a polyimide-containing layer surrounding the electrically conductive element and positioned between said electrically conductive element and said electrically insulating fluoropolymer layer.

Preferably, the electrical cable is exempt from polyimide-containing layer (surrounding said electrically conductive element).

More particularly, the expression "polyimide-containing layer" is understood to mean a polyimide layer, especially such as the one described in document EP 1 498 909. Generally, a polyimide is an organic polymer containing imide groups in its macromolecular chain.

The Applicant has discovered that, surprisingly, according to the present invention, removing the one or more prior-art polyimide-containing layers surrounding the electrically conductive element advantageously allows the resistance of said cable to partial discharges to be increased, whatever the diameter of the cable, its moisture resistance to be improved, and its resistance to the propagation of electrical arcs to be improved.

More particularly, the polyimide layer of the prior art is typically used in tape form, and is wound helically around the elongate electrically conductive element, an electrically insulating fluoropolymer layer surrounding this wound polyimide layer. Thus, the arrangement of the polyimide layer in tape form creates voids, on the one hand between the electrically conductive element and the tape, and on the other hand between the fluoropolymer layer and the tape, these voids being unfavorable for resistance to partial discharges.

The expression "electrically insulating layer" is understood to mean a layer the electrical conductivity of which is lower than $1\times10^{-9}$ $S\cdot m^{-1}$ (siemens per meter) at room temperature (25° C.).

The electrically insulating fluoropolymer layer of the invention comprises at least one fluoropolymer, especially chosen from polytetrafluoroethylene (PTFE); fluorinated ethylene-propylene copolymers (FEP) such as, for example, poly(tetrafluoroethylene-co-hexafluoropropylene); perfluoroalkoxy copolymers (PFA) such as, for example, tetrafluoroethylene/perfluoro(alkylvinylether) copolymers; perfluoromethoxy copolymers (MFA); and ethylene-tetrafluoroethylene (ETFE); or one of their combinations.

Preferably, the electrically insulating fluoropolymer layer is a layer of PTFE. The PTFE may generally be extruded using techniques that are well known in the art, especially paste extrusion. Before this paste extrusion, a preform is conventionally produced from PTFE powder, said preform then being extruded. The PTFE layer may furthermore be sintered, using techniques well known in the art.

Preferably, the electrically insulating fluoropolymer layer may comprise at least 50% by weight fluorocompound(s), preferably at least 70% by weight fluorocompound(s), and even more preferably at least 80% by weight fluorocompound (s), and even more preferably 90% by weight fluorocompound(s).

In order to optimize the resistance to partial discharges, it is preferable for the electrically insulating fluoropolymer layer to be an extruded layer.

More particularly, all the constituent electrically insulating fluoropolymer layers of the electrical cable of the invention are extruded layers.

In one particular embodiment, the electrically insulating fluoropolymer layer may make direct physical contact with the electrically conductive element.

The electrically insulating fluoropolymer layer of the invention may advantageously be a non-crosslinked layer, and more particularly a thermoplastic layer, especially one that is either sintered or non-sintered.

In the present invention, the expression "non-crosslinked layer" is understood to mean a layer that has not been subjected to a crosslinking step using techniques well known to those skilled in the art, the non-crosslinked layer of the invention in particular not having been obtained from a composition containing a crosslinking agent.

The one or more non-crosslinked layers in the present invention advantageously allow a very wide range of fluoropolymers to be used and thus an electrical cable able to resist high operating temperatures, especially of at least 200° C., even of 250° C. or more, to be obtained. Furthermore, the use of one or more non-crosslinked layers allows production costs to be cut significantly.

Optional Semiconductor Polymer Layer

The electrical cable of the invention may furthermore comprise at least one semiconductor polymer layer, said semiconductor polymer layer preferably comprising at least one fluoropolymer.

The semiconductor polymer layer of the invention may comprise at least one fluoropolymer, especially chosen from polytetrafluoroethylene (PTFE); fluorinated ethylene-propylene copolymers (FEP) such as, for example, poly(tetrafluoroethylene-co-hexafluoropropylene); perfluoroalkoxy copolymers (PFA) such as, for example, tetrafluoroethylene/perfluoro(alkylvinylether) copolymers; perfluoromethoxy copolymers (MFA); and ethylene-tetrafluoroethylene (ETFE); or one of their combinations.

Preferably, the semiconductor polymer layer may comprise at least 50% by weight fluorocompound(s), preferably at least 70% by weight fluorocompound(s), and even more preferably at least 80% by weight fluorocompound(s), and even more preferably 90% by weight fluorocompound(s).

The semiconductor polymer layer of the invention may conventionally comprise one or more electrically conductive fillers in sufficient amounts to make the layer semiconductor.

By way of example, it may comprise at least 0.1% by weight of electrically conductive filler(s), preferably at least 5% by weight of electrically conductive filler (s), preferably at least 10% by weight of electrically conductive filler(s), preferably at least 15% by weight of electrically conductive filler(s), and preferably at least 20% by weight of electrically conductive filler(s).

The maximum amount in the electrically insulating fluoropolymer layer may be at most 40% by weight of electrically conductive filler(s).

Mention may be made, by way of examples of electrically conductive fillers, of: carbon black, carbon nanotubes, etc.

The semiconductor polymer layer may be a layer extruded around the electrically conductive electrical element, or a layer taking the form of a tape wound around the electrically conductive electrical element, or a layer taking the form of a varnish deposited around the electrically conductive electrical element, or one of their combinations.

The expression "semiconductor layer" is more particularly understood to mean a layer of which the electrical conductivity is generally comprised between $1\times10^{-9}$ $S\cdot m^{-1}$ and $1\times10^{5}$ $S\cdot m^{-1}$ at room temperature, preferably between 0.01 $S\cdot m^{-1}$ and 25.0 $S\cdot m^{-1}$, and in particular preferably between 1.0 and 16.0 $S\cdot m^{-1}$.

The electrical cable of the invention may comprise:

a. a semiconductor polymer layer, such as defined in the invention, surrounding the elongate electrically conductive element, and positioned between the latter and the electrically insulating fluoropolymer layer; or b. a semiconductor polymer layer, such as defined in the invention, surrounding the electrically insulating fluoropolymer layer; or c. a first semiconductor polymer layer according to a, and a second semiconductor polymer layer according to b.

The first and second semiconductor polymer layers may be identical or different layers.

In a particular embodiment according to a, the semiconductor polymer layer may make direct physical contact with, on the one hand, the electrically insulating fluoropolymer layer, and on the other hand, with the electrically conductive element.

The semiconductor polymer layer of the invention may advantageously be a non-crosslinked layer, and more particularly a thermoplastic layer, especially one that is either sintered or non-sintered.

First Variant: Electrical Cable not Comprising a Semiconductor Polymer Layer

When the electrical cable of the invention does not comprise a semiconductor polymer layer, the total thickness of all of the electrically insulating fluoropolymer layers of the electrical cable of the invention is at least 0.40 mm, and preferably at least 0.50 mm.

The total thickness of all of the electrically insulating fluoropolymer layers of the electrical cable of the invention may be at most 0.70 mm.

Particularly advantageously, the electrically insulating fluoropolymer layer may make direct physical contact with the electrically conductive element.

Second Variant: Electrical Cable Comprising at Least One Semiconductor Polymer Layer When the electrical cable of the invention comprises at least one semiconductor polymer layer, the total thickness of all the electrically insulating fluoropolymer layers is at least 0.10 mm. Thus, in this variant, the total thickness does not take the thickness of the one or more semiconductor polymer layers into account.

The total thickness of all the electrically insulating fluoropolymer layers of the electrical cable of the invention may be at most 0.70 mm.

Thus, the presence of at least one semiconductor polymer layer advantageously allows the minimum thickness of the one or more electrically insulating fluoropolymer layers to be decreased, while limiting partial discharges.

In an advantageous embodiment, all the constituent layers of the electrical cable of the invention coaxially surround the elongate electrically conductive element.

The recommended elongate electrically conductive element according to the invention is for example a solid or multi-strand element, and may be made of copper (Cu), tin-plated copper, silver-plated copper, nickel-plated copper, aluminum (Al), nickel-plated aluminum, or nickel-plated copper-clad aluminum.

In a particular embodiment, all the constituent layers of the cable of the invention are non-crosslinked layers, and more particularly are thermoplastic layers, especially layers that are either sintered or non-sintered.

In the present invention, the elongate electrically conductive element may be positioned in the center of the electrical cable.

Preferably, the electrically insulating fluoropolymer layer, and optionally the semiconductor layer when it exists, may be positioned coaxially around the elongate electrically conductive element.

Particularly preferably, all the constituent layers of the electrical cable of the present invention may be positioned coaxially around the elongate electrically conductive element.

The electrical cable of the invention may furthermore comprise a metal screen surrounding the second semiconductor polymer layer.

This metal screen may be what is called a "braided" screen composed of a set of copper- or aluminum-based conductors arranged around and along the second semiconductor polymer layer, what is called a "foil" screen composed of one or more conductive metal foils wound in a helix around the second semiconductor polymer layer, or what is called a "solid" screen composed of a metal tube surrounding the second semiconductor polymer layer. The latter type of screen in particular forms a barrier to moisture that has a tendency to penetrate the electrical cable in a radial direction.

All the types of metal screens may be used to ground the electrical cable, and may thus channel failure currents, for example in the case of a short circuit in the related network.

Furthermore, the electrical cable of the invention may comprise a protective cladding surrounding the electrically insulating fluoropolymer layer, this protective cladding preferably being the outermost layer of the electrical cable of the invention, especially in order to allow information liable to be marked thereon to be seen directly.

Said protective cladding may therefore be able to be marked.

Of course, if the electrical cable according to the invention comprises a semiconductor polymer layer surrounding the electrically insulating fluoropolymer layer, said protective cladding preferably surrounds said semiconductor polymer layer.

The protective cladding may be a fluoropolymer-based layer (for example based on fluoropolymers such as PTFE, FEP, PFA and/or ETFE) and/or a polyimide-based layer. Other materials well known to those skilled in the art in the aeronautics field may of course be used. Said outer layer may take the form of a tape, an extrudate or a varnish.

In the present invention, said protective cladding must not in particular be considered as an electrically insulating fluoropolymer layer such as defined in the invention, especially for the calculation of the thicknesses in the first variant and in the second variant of the invention.

The electrical cable of the invention is more particularly intended, to be used in the aeronautics field, especially under about 230 V AC or about ±270 V DC.

BRIEF DESCRIPTION OF THE DRAWINGS

Other features and advantages of the present invention will become apparent in light of the annotated figures, said figures being completely nonlimiting and given by way of illustration.

DETAILED DESCRIPTION

For the sake of clarity, only elements that are essential to the understanding of the invention have been schematically shown, and these elements have not been shown to scale.

Figure 1:
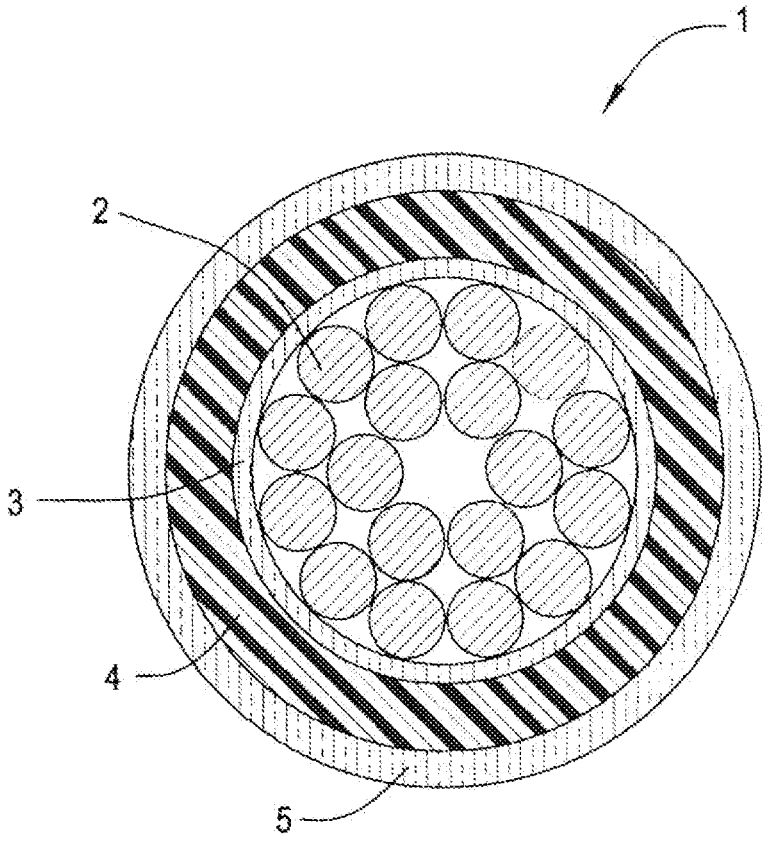
FIG. 1 shows a schematic cross-sectional view of an electrical cable according to one particular embodiment, conforming to the invention.

The hook-up wire or electrical power cable 1 shown in FIG. 1, comprises:

- a central electrically conductive element 2, especially made of copper or aluminum, of the multi-strand type;
- a first semiconductor fluoropolymer layer 3, taking the form of a tape surrounding said conductive element 2;
- an extruded electrically insulating fluoropolymer layer 4 surrounding the first layer 3; and
- a second semiconductor fluoropolymer layer 5 taking the form of a tape surrounding said layer 4.

The electrically insulating fluoropolymer layer 4 makes direct physical contact with the first and second semiconductor layers 3, 5.

The electrically insulating fluoropolymer layer 4 is an extruded PTFE layer obtained from PTFE powder sold by DUPONT under the reference CFP 6000 N.

Of course, other types of fluoropolymer may be used, such as:

- the FEP sold by DAIKIN under the reference NEOFLON NP20;
- the PFA sold by DYNEON under the reference 6515 TZ; or
- the ETFE sold by DAIKIN under the reference NEOFLON EP541.

These polymers are thermoplastic polymers and may be easily extruded using techniques well known in the art.

The first and second semiconductor polymer layers are PTFE tapes, sold by SAINT-GOBAIN under the reference DF1400-2F, having an initial thickness of 60 μm.

To produce the electrical cable in FIG. 1, first of all a first PTFE tape is wound around the electrically conductive element 2 in order to form the first semiconductor polymer layer 3. The first semiconductor polymer layer 3 thus formed may comprise a plurality of windings for a given tape in order thereby to increase its thickness.

After a rod-type preform has been formed from the PTFE powder, said preform is extruded around the first semiconductor layer 3 in order to form the extruded electrically insulating PTFE layer 4. The thickness of the extruded electrically insulating layer 4 may be comprised between 0.10 and 0.70 mm.

Lastly, a second PTFE tape is helically wound around the extruded electrically insulating PTFE layer 4 in order to form the second semiconductor polymer layer 5. The second semiconductor polymer layer 5 thus formed may comprise a plurality of windings for a given tape in order thereby to increase it thickness.

The semiconductor polymer layers 3, 5 made of PTFE may be sintered. The sintering is conventionally carried out by heat treating (e.g. using an oven for example) the wound layers of PTFE at a temperature above 340° C.

The sintering of the first and second semiconductor polymer layers made of PTFE may be carried out in different ways.

As a first variant, the first semiconductor polymer layer 3 made of PTFE is sintered before the electrically insulating layer 4 has been fitted, then the second semiconductor polymer layer 5 made of PTFE is sintered once wound around the electrically insulating layer 4.

As a second variant, the sintering is only carried out, once the first and second semiconductor polymer layers 3, 5 made of PTFE have been fitted.

Figure 2:
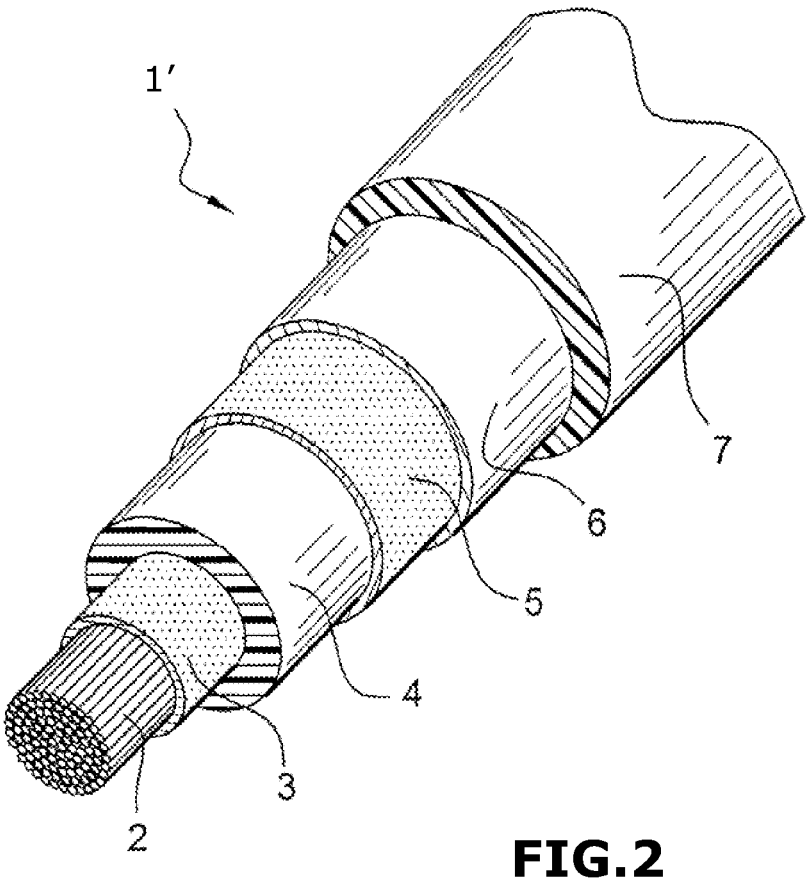
FIG. 2 shows a schematic semi-exploded perspective view of an electrical cable according to another particular embodiment conforming to the invention.

The electrical cable 1' illustrated in FIG. 2 is the same as the electrical cable in FIG. 1 except that it furthermore comprises a grounding and/or protecting metal screen 6 surrounding the second semiconductor fluoropolymer layer 5, and a protective cladding 7 surrounding the metal screen 6.

The invention claimed is:

1. Electrical cable comprising:

an elongate electrically conductive element; and at least one electrically insulating fluoropolymer layer, surrounding said electrically conductive element, wherein the electrical cable is exempt from polyimide-containing layer between said electrically conductive element and said electrically insulating fluoropolymer layer and wherein said electrical cable does not comprise a semiconductor polymer layer, and wherein the total thickness of all the electrically insulating fluoropolymer layers is at least 0.40 mm.

2. Electrical cable according to claim 1, wherein the electrical cable is exempt from polyimide-containing layers.

3. Electrical cable according to claim 1, wherein the electrically insulating fluoropolymer layer is an extruded layer.

4. Electrical cable according to claim 1, wherein the electrically insulating fluoropolymer layer comprises polytetrafluoroethylene (PTFE); fluorinated ethylene-propylene copolymers (FEP); perfluoroalkoxy copolymers (PFA); perfluoromethoxy copolymers (MFA); and ethylene-tetrafluoroethylene (ETFE).

5. Electrical cable according to claim 1, wherein the electrically insulating fluoropolymer layer is a non-crosslinked.

6. Electrical cable according to claim 1, wherein the electrically insulating fluoropolymer layer makes direct physical contact with the electrically conductive element.

7. Electrical cable comprising:

an elongate electrically conductive element; and at least one electrically insulating fluoropolymer layer, surrounding said electrically conductive element, and one or more semiconductor polymer layers wherein the electrical cable is exempt from polyimide-containing layer between said electrically conductive element and said electrically insulating fluoropolymer layer, and wherein the total thickness of all the electrically insulating fluoropolymer layers is at least 0.10 mm.

8. Electrical cable according to claim 7, wherein the total thickness of all the electrically insulating layers is at most 0.70 mm.

9. Electrical cable according to claim 7, wherein the one or more semiconductor polymer layers comprise at least one fluoropolymer.

10. Electrical cable according to claim 9, wherein the fluoropolymer is selected from polytetrafluoroethylene (PTFE); fluorinated ethylene-propylene copolymers (FEP); perfluoroalkoxy copolymers (PFA); perfluoromethoxy copolymers (MFA); and ethylene-tetrafluoroethylene (ETFE).

11. Electrical cable according to claim 7, wherein said electrical cable comprises a semiconductor polymer layer surrounding the electrically insulating fluoropolymer layer.

12. Electrical cable according to claim 7, wherein said electrical cable comprises:

a first semiconductor polymer layer surrounding the elongate electrically conductive element, the electrically insulating fluoropolymer layer surrounding said first semiconductor polymer layer; and a second semiconductor polymer layer surrounding the electrically insulating fluoropolymer layer.

13. Electrical cable according to claim 7, wherein the electrical cable is exempt from polyimide-containing layers.

14. Electrical cable according to claim 7, wherein the electrically insulating fluoropolymer layer is an extruded layer.

15. Electrical cable according to claim 7, wherein the electrically insulating fluoropolymer layer comprises polytetrafluoroethylene (PTFE); fluorinated ethylene-propylene copolymers (FEP); perfluoroalkoxy copolymers (PFA); perfluoromethoxy copolymers (MFA); and ethylene-tetrafluoroethylene (ETFE).

16. Electrical cable according to claim 7, wherein the electrically insulating fluoropolymer layer is a non-crosslinked layer.

* * * * *